US008276670B2

(12) United States Patent
Patel

(10) Patent No.: US 8,276,670 B2
(45) Date of Patent: Oct. 2, 2012

(54) DOWNHOLE DISSOLVABLE PLUG

(75) Inventor: Dinesh R. Patel, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 414 days.

(21) Appl. No.: 12/430,298

(22) Filed: Apr. 27, 2009

(65) Prior Publication Data

US 2010/0270031 A1 Oct. 28, 2010

(51) Int. Cl.
*E21B 33/12* (2006.01)

(52) U.S. Cl. ..... 166/317; 166/192; 166/188; 166/319; 166/376

(58) Field of Classification Search ..... 166/192, 166/188, 317, 319, 376
See application file for complete search history.

(56) References Cited

U.S. PATENT DOCUMENTS

| | | | | |
|---|---|---|---|---|
| 5,479,986 | A * | 1/1996 | Gano et al. | 166/292 |
| 5,607,017 | A | 3/1997 | Owens et al. | |
| 5,685,372 | A * | 11/1997 | Gano | 166/292 |
| 5,765,641 | A | 6/1998 | Shy et al. | |
| 5,826,661 | A * | 10/1998 | Parker et al. | 166/386 |
| 6,041,864 | A | 3/2000 | Patel et al. | |
| 6,076,600 | A | 6/2000 | Vick, Jr. et al. | |
| 6,119,783 | A * | 9/2000 | Parker et al. | 166/386 |
| 6,161,622 | A | 12/2000 | Robb et al. | |
| 6,220,350 | B1 | 4/2001 | Brothers et al. | |
| 6,431,276 | B1 * | 8/2002 | Robb et al. | 166/192 |
| 6,904,975 | B2 | 6/2005 | Horne et al. | |
| 7,270,191 | B2 | 9/2007 | Drummond et al. | |
| 7,380,600 | B2 | 6/2008 | Willberg et al. | |
| 7,565,929 | B2 | 7/2009 | Bustos et al. | |
| 7,703,511 | B2 * | 4/2010 | Buyers et al. | 166/192 |
| 2007/0251698 | A1 | 11/2007 | Gramstad et al. | |
| 2007/0277979 | A1 * | 12/2007 | Todd et al. | 166/287 |
| 2008/0105438 | A1 | 5/2008 | Jordan et al. | |
| 2011/0042099 | A1 * | 2/2011 | Williamson et al. | 166/373 |

FOREIGN PATENT DOCUMENTS

EP 775804 A2 * 5/1997

* cited by examiner

*Primary Examiner* — Kenneth L Thompson
*Assistant Examiner* — Elizabeth Gottlieb
(74) *Attorney, Agent, or Firm* — Chadwick Sullivan; Rodney Warfford; Matthias Abrell

(57) ABSTRACT

A downhole plug can include a housing having an aperture disposed generally through the center of the housing. A stopper can be disposed in the aperture and adapted to block fluid flow therethrough. The stopper can have a composition of at least two different materials. One or more covers can be at least partially disposed on the stopper, wherein and the stopper can be at least partially encapsulated by the one or more covers. A flow control device can be disposed adjacent the stopper to selectively introduce fluid to at least a portion of the stopper.

23 Claims, 3 Drawing Sheets

DOWNHOLE DISSOLVABLE PLUG

BACKGROUND

Regulating downhole pressures in an oil and gas well is often required to set pressure actuated downhole tools, such as packers and bridge plugs, and for performing hydraulic formation fracturing, well logging, and other known operations that can be associated with well drilling, well completion, and/or well production. Hydraulic packers, for example, can be actuated by applying pressure through the borehole tubing to the packer. However, the tubing below the packer must be plugged to build sufficient pressure to set the packers. A two-way barrier is often used to hold the pressure from below for well control and hold the pressure from above for fluid loss control or setting packers. Normally a plug is run on slickline, wireline, coiled tubing, or pipe and set below the packer to act as the two-way barrier. After setting the packer and any other operations requiring the two-way barrier, the plug is retrieved to clear the flow path.

Pressure actuated devices, such as formation isolation valves, sliding sleeves, and circulating valves, generally use shear pins or metal rupture discs to block the downhole pressure from inadvertently operating the downhole device. An intervention operation, such as the application of a shear force that is generated at the surface and translated through the wellbore via the work string, is typically used to rupture the disc or shear the pins in order to actuate the devices. In some environments, however, such as an open hole, sufficient pressure cannot be obtained to provide the shear force needed to rupture the disc or shear the pins. There is also a risk of not being able to successfully remove the pressure actuated device when no longer need, which may require a milling operation to remove instead.

There is a need, therefore, for new apparatus and systems that can decrease or eliminate the necessity for intervention and/or milling operations, thereby save valuable rig time, increase operational flexibility, and minimize milling operations or other interventions.

SUMMARY

A downhole plug and method for using the same are provided. In at least one specific embodiment, the downhole plug can include a housing having an aperture disposed generally through the center of the housing, a stopper having a composition of at least two different materials, and one or more covers at least partially disposed on the stopper. The stopper is at least partially encapsulated by the one or more covers, and the stopper is disposed in the aperture and adapted to block fluid flow therethrough. A flow control device can be disposed adjacent the stopper to selectively introduce fluid to at least a portion of the stopper.

In at least one specific embodiment, the method can include positioning a downhole plug within a wellbore, wherein the plug can include: a housing having an aperture disposed generally through the center of the housing, a stopper having a composition of at least two different materials, one or more covers at least partially disposed on the stopper, wherein the stopper is at least partially encapsulated by the one or more covers, and wherein the stopper is disposed in the aperture and adapted to block fluid flow therethrough, and a flow control device disposed adjacent the stopper to selectively introduce fluid to at least a portion of the stopper; performing wellbore operations supported by the downhole plug; and clearing the aperture by actuating the flow control device to introduce fluid onto the stopper to clear the blockage and allow fluid flow through the housing.

BRIEF DESCRIPTION OF THE DRAWINGS

So that the recited features can be understood in detail, a more particular description, briefly summarized above, may be had by reference to one or more embodiments, some of which are illustrated in the appended drawings. It is to be noted, however, that the appended drawings illustrate only typical embodiments and are therefore not to be considered limiting of its scope, for the invention may admit to other equally effective embodiments.

DETAILED DESCRIPTION

Figure 1:
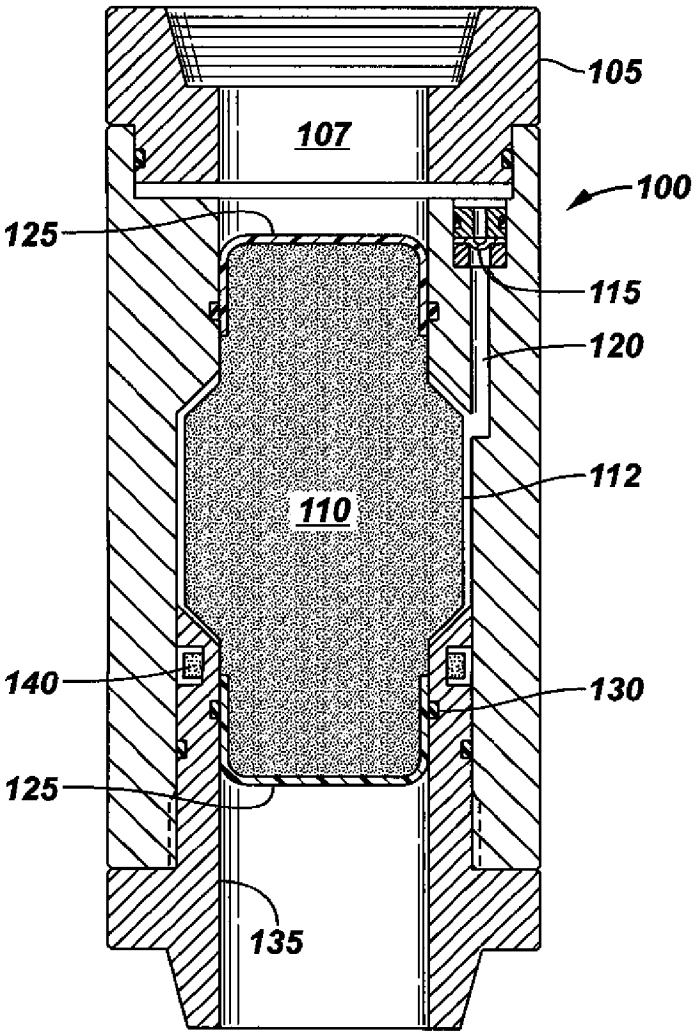
FIG. 1 depicts a cross section view of an illustrative downhole plug assembly, according to one or more embodiments described.

FIG. 1 depicts a cross section view of an illustrative downhole plug assembly, according to one or more embodiments. The plug assembly 100 can include one or more housings 105, plugs or stoppers 110, one or more flow control devices 115, and one or more fluid by-pass channels 120. The housing 105 can include an aperture, opening, or bore 107 formed therethrough. The stopper 110 can be at least partially disposed within the aperture 107 of the housing 105. The one or more flow control devices 115 can be disposed within the housing 105, and can be in fluid communication with the aperture 107 of the housing 105 and the stopper 110 disposed therein via the one or more fluid by-pass channels 120.

The stopper 110 can prevent a fluid from flowing between a first end ("upper end") and a second end ("lower end") of the housing 105. The stopper 110 can be any size or shape. In one or more embodiments, the stopper 110 can be constructed as a single piece or as an assembly of two or more pieces or components. The stopper 110 can also be malleable, for example like an elastomer or rubber, and/or a semi-solid composition.

The stopper 110 can be made from one or more degradable and/or reactive materials. The stopper 110 can be partially or wholly degradable (soluble) in a designated fluid environment, such as water, brine, or other injection fluid, production fluid, drilling fluid, and/or combinations thereof. In one or more embodiments, the stopper 110 can be made from one or more materials that disintegrate but not necessarily dissolve in a designated fluid environment. In one or more embodiments, the stopper 110 can include compositions engineered to exhibit enhanced reactivity relative to other compositions that can be present in the stopper 110.

In at least one specific embodiment, the stopper 110 can include a combination of normally insoluble metal or alloys. Suitable metals can include iron, titanium, copper, combinations of these, and the like, among other metals. In at least one specific embodiment, the stopper 110 can further include a combination of two or at least partially soluble and/or blendable elements selected from metals or alloys, semi-metallic elements, and/or non-metallic elements to form metal alloys and composite structures of poor stability in the designated fluid environment. Such soluble or blendable elements can include metals, semi-metallic elements, and non-metallic elements including but not limited to gallium, indium, tin, antimony, combinations of these, and the like; semi-metallic elements such as carboxylated carbon (e.g. in graphitic or nanotube form), and organic compounds such as sulfonated polystyrene, styrene sulfonic acid, and compositions comprising non-metallic materials such as oxides (anhydride), carbonates, sulfides, chlorides, bromides, acid-producing or basic producing polymers, or in general fluid pH changing polymers. One or more of the non-metallic materials can contain metals that are chemically-bonded to non-metallic elements (wherein the bonds may be ionic, covalent, or any degree thereof). These materials can include, but are not limited to, alkaline and alkaline-earth oxides, sulfides, chlorides, bromides, and the like. These materials, alone, are at least partially water-soluble and, when properly combined (e.g. blended) with normally insoluble metals and alloys, can degrade the chemical resistance of the normally insoluble metals by changing the designated fluid chemistry, including its corrosiveness, thus creating galvanic cells, among other possible mechanisms of degradations. Examples of normally insoluble metals and alloys made soluble through the additions of elements, include polymers, that can directly destabilize the metallic state of the normally insoluble element for a soluble ionic state (e.g. galvanic corrosion, lower pH created by acid-polymers), and/or can indirectly destabilize the metallic state by promoting ionic compounds such as hydroxides, known to predictably dissolve in the designated fluid environment. In one or more embodiments, the stopper 110 can include compositions that can produce exothermic reactions occurring in fluid, such as water, that can act as trigger to the degradation of one of the compositions. The ratio of normally insoluble metal to metallurgically soluble or blendable elements can be dependent on the end use of the stopper 110, the pressure, temperature, and stopper 110 lifetime requirements as well as the fluid environment compositions. For example, the ratio of normally insoluble metal to metallurgically soluble or blendable elements can be, without limitation, in the range of from about 4:1 to about 1:1.

The stopper 110 can include one or more solubility-modified high strength and/or high-toughness polymeric materials such that polyamides (including but not limited to aromatic polyamides), polyethers, and liquid crystal polymers. As used herein, the term "polyamide" denotes a macromolecule containing a plurality of amide groups, i.e., groups of the formula —NH—C(.dbd.O)— and/or —C(.dbd.O)—NH—. Polyamides as a class of polymer are known in the chemical arts, and are commonly prepared via a condensation polymerization process whereby diamines are reacted with dicarboxylic acid (diacids). Copolymers of polyamides and polyethers can also be used, and may be prepared by reacting diamines with diacids.

The stopper 110 can include aromatic polyamides including those generically known as aramids. Aramids are highly aromatic polyamides characterized by their flame retardant properties and high strength. They have been used in protective clothing, dust-filter bags, tire cord, and bullet-resistant structures. They can be derived from reaction of aromatic diamines, such as para- and/or meta-phenylenediamine, and a second monomer, such as terephthaloyl chloride.

The stopper 110 can include liquid crystal polymers (LCPs) (e.g. lyotropic liquid crystal polymers and thermotropic liquid crystal polymers) having one or more mesogen groups in a main chain or a side chain. The stopper 110 can include those polymers whose molecules have a tendency to align themselves and remain in that alignment. They can comprise a diverse family although most are based on polyesters and polyamides. In their molecular structure, LCPs do not fit into the conventional polymer categories of amorphous and semi-crystalline, displaying a high degree of crystallinity in the melt phase, hence 'liquid crystal'. LCPs are essentially composed of long, rod-like molecules that align themselves in the direction of material flow. This alignment can be maintained as solidification takes place, hence they are referred to as 'self reinforcing'. The crystalline nature imparts excellent resistance to solvents, industrial chemicals, and UV and ionizing radiations.

As the main chain type liquid crystal polymers showing thermotropic liquid crystal properties, one class that can be used are polyester series liquid crystal polymers. For example, a copolymer of polyethylene terephthalate and p-hydroxybenzoic acid shows liquid crystal properties in a wide range of composition and may be dissolved in chloroform, a mixed solvent of phenol/tetrachloroethane, and the like.

As used herein the term "high-strength" means a composition that possesses intrinsic mechanical strengths, including quasi-static uniaxial strengths and hardness values at least equal to and typically greater than that of pure metals.

To create compositions within the stopper 110 having high-strength and that have controllable and thus predictable degradation rate, one of the following morphologies, broadly speaking, can be appropriate, depending on the end use. For example, a reactive, degradable metal or alloy formed into a solidified (cast) or extruded (wrought) composition of crystalline, amorphous or mixed structure (e.g. partially crystalline, partially amorphous) can be used. The features characterizing the resulting compositions (e.g. grains, phases, inclusions, and like features) can be of macroscopic, micron or submicron scale, for instance nanoscale, so as to measurably influence mechanical properties and reactivity.

In one or more embodiments, the term "reactive" can include any material, composition or element that tends to form positive ions when at least partially dissolved in liquid solution and whose oxides form hydroxides rather than acids with water. Also included among reactive metals and compositions are metals and compositions that disintegrate and can be practically insoluble in the fluid environment. Examples of such compositions can include alloys that lose structural integrity and become dysfunctional for instance due to grain-boundary embrittlement or dissolution of one of its elements. The byproduct of this degradation from the grain boundaries may not be an ionic compound such as a hydroxide but a metallic powder residue, as appears to be the case of severely embrittled aluminum alloys of gallium and indium. Unless oxidized or corroded at their surfaces, one or more of these compositions can be electrically conductive solids with metallic luster. Many also can possess high mechanical strength in tension, shear and compression and therefore can exhibit high hardness. Many reactive metals useful in the stopper 110 can also readily form limited solid solutions with other metals, thus forming alloys, novel alloys and increasingly more complex compositions such as composite and hybrid structures of these novel alloys. Regarding alloying elements in these alloys, very low percentages can often be enough to affect the properties of the one or more metals or, e.g., carbon (C) in iron (Fe) to produce steel.

In one or more embodiments, the stopper 110 can include a degradable alloy composition. Degradable alloy compositions can include alloy compositions that degrade largely due to the formation of internal galvanic cells between structural heterogeneities (e.g. phases, internal defects, inclusions, and in general internal compositions) and/or resist or entirely prevent passivation or the formation of stable protective layers. The presence of alloying elements trapped in solid solution, for instance in aluminum, can impede the aluminum from passivating or building a resilient protective layer. In one or more embodiments, concentrations of solute elements, trapped in interstitial and especially in substitutional solid solutions can be controlled through chemical composition and processing; for instance rapid cooling from a high temperature where solubility is higher than at ambient temperature or temperature of use. Other degradable compositions can include elements, or phases that can melt once elevated beyond a certain critical temperature or pressure, which for alloys can be predictable from phase diagrams, or if phase diagrams are unavailable, from thermodynamic calculations as in the CALPHAD method. In one or more embodiments, the compositions can be selected to intentionally fail by liquid-metal embrittlement, as in some alloys containing gallium and/or indium for instance. Other degradable compositions, can possess phases that are susceptible to creep or deformation under intended forces and/or pressures, or can possess phases that are brittle and thus rapidly rupture under impact. Examples of degradable compositions, can include calcium alloys; e.g. calcium-lithium (Ca—Li), calcium-magnesium (Ca—Mg), calcium-aluminum (Ca—Al), calcium-zinc (Ca—Zn), and the like, including more complex compositions like calcium-lithium-zinc (Ca—Li—Zn) alloys without citing their composites and hybrid structures.

In calcium-based alloys, alloying addition of lithium in concentrations between about 0 up to about 10 weight percent is beneficial to enhance reactivity. Greater concentrations of lithium in equilibrium calcium-lithium (Ca—Li) alloys can form an intermetallic phase, still appropriate to enhance mechanical properties, but often degrades reactivity slightly. In addition to lithium, in concentrations ranging from about 0 up to about 10 weight percent, aluminum, zinc, magnesium, and/or silver in up to about 1 weight percent can also be favorable to improve mechanical strengths. Other degradable composition embodiments can include magnesium-lithium (Mg—Li) alloys enriched with tin, bismuth or other low-solubility alloying elements, as well as special alloys of aluminum, such as aluminum-gallium (Al—Ga) or aluminum-indium (Al—In), as well as more complex alloying compositions; e.g. aluminum-gallium-indium (Al—Ga—In), aluminum-gallium-bismuth-tin (Al—Ga—Bi—Sn) alloys, and more complex compositions of these alloys.

A powder-metallurgy like structure including a relatively reactive metal or alloy can be combined with other compositions to develop galvanic couples. For example, a composition with a structure developed by pressing, compacting, sintering, and the like, formed by various schedules of pressure and temperature can include an alloy of magnesium, aluminum, and the like, can be combined with an alloy of copper, iron, nickel, among a few transition-metal elements to develop galvanic couples. The result of these combinations of metals, alloys or compositions can be a new degradable composition that can also be characterized as a composite composition. However, because of the powder-metallurgy like structure, voids or pores can be intentionally left in order to promote the rapid absorption of corrosive fluid and thus rapid degradation of the formed compositions.

Such compositions can include one or more of fine-grain materials, ultra-fine-grain materials, nanostructured materials as well as nanoparticles for enhanced reactivity or rates of degradation as well as low temperature processing or manufacturing. The percentage of voids in such powder-metallurgy composition can be controlled by the powder size, the composition-making process, and the process conditions such that the mechanical properties and the rates of degradation can become predictable and within the requirements of the applications or end users. Selecting from the galvanic series elements that are as different as possible in galvanic potential can be one way of manufacturing these compositions.

Composite and hybrid structures can include one or more reactive and/or degradable metals or alloys as a matrix, imbedded with one or more relatively non-reactive compositions of micro-to-nanoscopic sizes (e.g. powders, particulates, platelets, whiskers, fibers, compounds, and the like) or made from the juxtaposition of layers, bands and the like, as for instance in functionally-graded materials. In contrast with compositions above, these compositions can be closer to conventional metal-matrix composites in which the matrix can be degradable and the imbedded materials can be inert and ultra-hard so as to purposely raise the mechanical strength of the formed composition. Examples of a metal-matrix composite structure can be comprised of any reactive metal (e.g. pure calcium, Ca) or degradable alloy (e.g. aluminum-gallium based alloy, Al—Ga), while relatively non-reactive compositions can include particles, particulates, powders, platelets, whiskers, fibers, and the like that are expected to be inert under the environmental conditions expected during use. These composite structures can include aluminum-gallium (Al—Ga) based alloys (including complex alloys of aluminum-gallium (Al—Ga), aluminum-gallium-indium (Al—Ga—In), aluminum-gallium-indium-bismuth (Al—Ga—In—Bi) as examples) reinforced with, for example, silicon carbide (SiC), boron carbide (BC) particulates (silicon carbide and boron carbide are appropriate for casting because of their densities, which are comparable to that of aluminum-gallium based alloys). Mechanical strength and its related properties, can be estimated by a lever rule or rule of mixture, where strength or hardness of the metal-matrix composite is typically proportional to volume fraction of the material strength (hardness) of both matrix and reinforcement materials.

In one or more embodiments, the stopper 110 can be manufactured by pouring a degradable and/or reactive composition into a mold. The stopper 110 can be manufactured by milling a degradable and/or reactive composition into a desired shape. The housing 105 can be used as the mold. As such, the stopper 110 can be manufactured by directly pouring a degradable and/or reactive composition into the aperture 107 of the housing 105.

In one or more embodiments, the stopper 110 can be one or more combinations of distinct compositions used together as a part of a new and more complex composition because of their dissimilar reactivities and/or strengths, among other properties. The stopper 110 can include composites, functionally-graded compositions, and other multi-layered compositions regardless of the size or scale of the components or particles that make up the composition. In one or more embodiments, the reactivity of the composition can be selected by varying the scale of the components that make up the composition. For example, varying reactivities and thus the rate of degradation can be achieved by selecting macro-, meso-, micro- and/or nanoscale components within the composition.

In one or more embodiments, delaying the interaction of the stopper 110 reactive compositions with a corrosive fluid can be used to control reactivity. In one or more embodiments, the stopper 110 can be controllably reactive under conditions controlled by oilfield personnel. For example, the stopper 110 can be controllably reactive by oilfield personnel remotely varying a fluid flow through the fluid by-pass channel 120.

In one or more embodiments, the stopper 110 can be at least partially encapsulated within one or more covers 125. The first end or "upper end" of the stopper 110 can be encapsulated by a first cover 125 that can prevent fluid from contacting the upper end of the stopper 110. The second end or "lower end" of the stopper 110 can be encapsulated by a second cover 125 that can prevent fluid from contacting the lower end of the stopper 110.

In one or more embodiments, the covers 125 can be any shape or size. The covers 125 can be shaped or sized to fit over at least a portion of the stopper 110. The covers 125 can be non-permeable. The covers 125 can be manufactured from poly(etheretherketone) ("PEEK"). In one or more embodiments, the cover 125 can be glass, TEFLON coating, ceramic, a thin metallic film, molded plastic, steel, shape memory alloy, and/or any other material that can prevent the upper and/or lower portions of the stopper 110 from contacting wellbore fluids. In one or more embodiments, the cover 125 can be fractured, ruptured, or otherwise broken by mechanically asserted forces or changes in pressure and/or temperature.

One or more seals 130 can be disposed between the one or more covers 125 and the inner wall 135 of the housing 105. The seals 130 can act as a fluid barrier between the cover 125 and the housing 105. Accordingly, the seals 130 can prevent fluid from contacting an exposed portion 112 of the stopper 110. The exposed portions of the stopper 110 are those surfaces or areas of the stopper 110 that are not covered or otherwise protected by the covers 125. The seals 130 can be any shape or size, and can be made of one or more elastomeric materials or any other suitable materials.

In use, the stopper 110 can be disintegrated, decomposed, degraded, or otherwise compromised after the exposed portion 112 comes into contact with wellbore fluid, tubing fluid, and/or combinations thereof to allow fluid flow therethrough. In one or more embodiments, the surface area of the exposed portion 112 can be varied to adjust the rate of fluid induced degradation of the stopper 110.

In one or more embodiments, the exposed portion 112 can be coated with a material for absorbing fluid that can at least partially control the flow rate of contact between the exposed portion 112 and any fluid present or introduced to any portion of the exposed portion 112. Suitable coatings can include a capillary material generally referred to as bonded polyester fiber (BPF). BPF is composed of multiple fiber strands bonded together where each fiber is randomly oriented; however, the BPF block has a "grain", or preferred capillary direction. In one or more embodiments, at least a portion of the stopper 110 can be coated with BPF such that the preferred capillary direction allows some fluid to penetrate through to a bare section of the stopper 110. In one or more embodiments, other materials such as bonded polypropylene or polyethylene fibers, nylon fibers, rayon fibers, polyurethane foam, or melamine, can be used.

Considering the fluid by-pass channel 120 in more detail, the fluid by-pass channel 120 can be formed within the wall of the housing 105. The fluid by-pass channel 120 can be any shape or size suitable for directing fluid around the covers 125 to the exposed portion 112 of the stopper 110. In one or more embodiments, the fluid by-pass channel 120 can be combined with the flow control devices 115. Suitable flow control devices 115 can include one or more rupture discs, one or more pressure actuated valves, one or more pressure transducers, and/or other known actuators that can be selectively operated to introduce fluid into the fluid by-pass channel 120 and/or onto the exposed portion 112 of the stopper 110.

In at least one specific embodiment, a rupture disc can be disposed somewhere along the fluid by-pass channel 120 to act as the flow control device 115. The rupture disc can prevent fluid from entering the fluid by-pass channel 120. Increasing the wellbore pressure above the flow control device 115 can burst the rupture disc and introduce wellbore fluid onto the exposed portion 112 of the stopper 110. The reaction between the wellbore fluid and the exposed portion 112 can decompose the stopper 110 and can allow fluid flow through the housing 105.

In one or more embodiments, the flow control device 115 can be a degradable composition of the same makeup as the stopper 110 and/or of a different composition. The degradable composition can be disposed in a portion of the fluid by-pass channel 120 or can fill the entire volume of the fluid by-pass channel 120. The degradable composition can be designed to dissolve at a specified rate, using known methods, such that wellbore fluid, can enter the fluid by-pass channel 120, after a specified exposure period by the degradable composition to wellbore fluid.

In one or more embodiments, moisture can be present in any cavities around the exposed portion 112. For example, moisture can be present around the seal 130 and the moisture could dissolve a portion of the stopper 110, impacting the structural integrity of the stopper 110. In one or more embodiments, a vacuum can be pulled to evacuate the cavities, or air in the cavities can be displaced with nitrogen gas or any other inert gas, a desiccant material 140 can be placed in fluid communications with the cavity, or the stopper 110 can be coated with a fluid absorbing coating that can slow the dissolve rate of the stopper 110 from any moisture present in the cavities.

Figure 2:
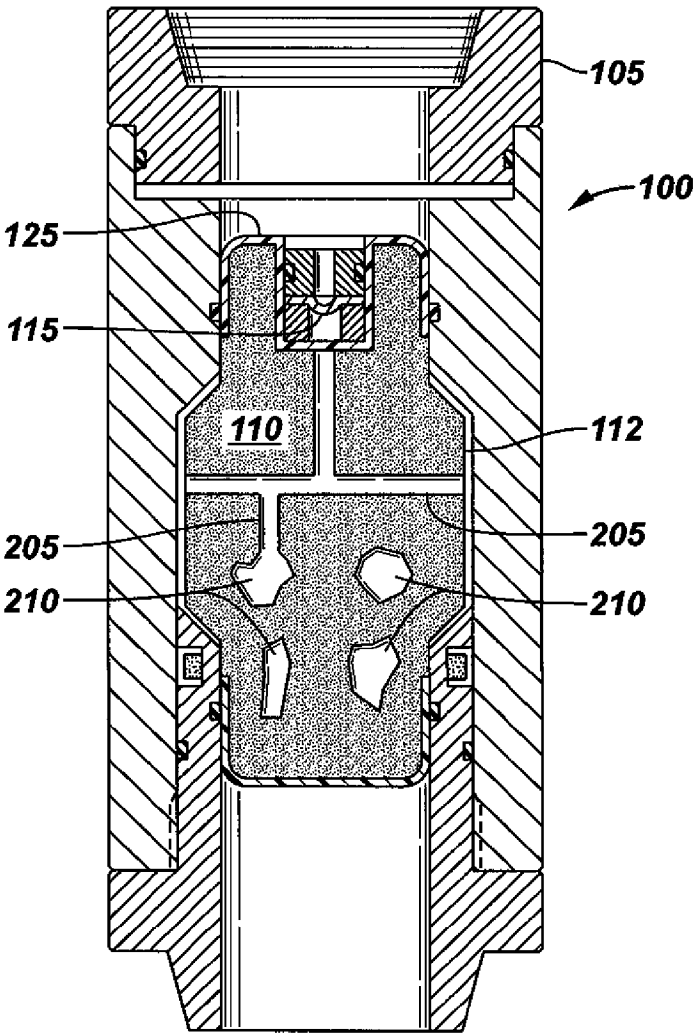
FIG. 2 depicts a cross section view of an illustrative downhole plug assembly with an integral flow control device, according to one or more embodiments described.

FIG. 2 depicts a cross section view of an illustrative downhole plug assembly with an integral flow control device, according to one or more embodiments. In one or more embodiments, the flow control device 115 can be integrated with at least one of the covers 125. The flow control device 115 can selectively prevent fluid from contacting the stopper 110. The flow control device 115 can include one or more actuators that can be selectively operated to introduce fluid onto and/or into the stopper 110. The flow control device 115 can include a disc made from metallic and/or non-metallic materials that can break into relatively small pieces upon application of a force across the disc. One or more of the non-metallic materials from which the disc can be made can be a glass or ceramic that can hold high force under compression but can break into relatively small pieces when an impact force is applied. In one or more embodiments, the disc can be fractured, ruptured, or otherwise broken by mechanically asserted forces or changes in pressure and/or temperature. For example, disc can be broken into relatively small pieces by dropping a bar onto the top of the disc. The disc can be broken into relatively small pieces by applying a tensile force such as a differential pressure across the disc. In one or more embodiments, the flow control device 115 can be a degradable composition identical to or similar to the composition of the stopper 110 and/or can be a different composition. Accordingly, the cover 125 can include a degradable composition that can act as a flow control device 115. For example, when wellbore fluid, tubing fluid, or combinations thereof contact the degradable composition integrated with the cover 125, the degradable composition can selectively degrade, eventually allowing wellbore fluid through the cover 125 and onto the stopper 110.

The stopper 110 can be solid, hollow, honeycombed, and/or contain one or more regularly shaped and sized or irregularly shaped and sized interior voids and/or exterior grooves 210, and/or combinations thereof. In one or more embodiments, the size of the interior voids can be varied to vary the rate of degradation of the stopper 110 upon contact with a fluid.

In one or more embodiments, a channel 205 can be formed in the interior of at least a portion of the stopper 110. The channel 205 can be in fluid communications with the flow control device 115. The channel 205 can be any shape or size and can direct fluid along an interior portion of the stopper 110 such that the structural integrity of the stopper 110 can be degraded by the introduction of fluid into the channel 205. In one or more embodiments, the surface area along the length of the channel 205 can be varied to adjust the rate of degradation of the stopper 110 upon introduction of fluid into the channel 205.

In at least one specific embodiment, the stopper 110 can be cleared from the housing 105 by actuating or breaking the flow control device 115 and allowing wellbore fluid, tubing fluid, and/or combinations thereof to enter the channel 205. Upon entering the channel 205, the fluid can contact the walls of the channel 205 causing the stopper 110 to degrade or dissolve. This process can continue until the stopper 110 has at least partially disintegrated, allowing fluid flow through the housing 105.

Figure 3:
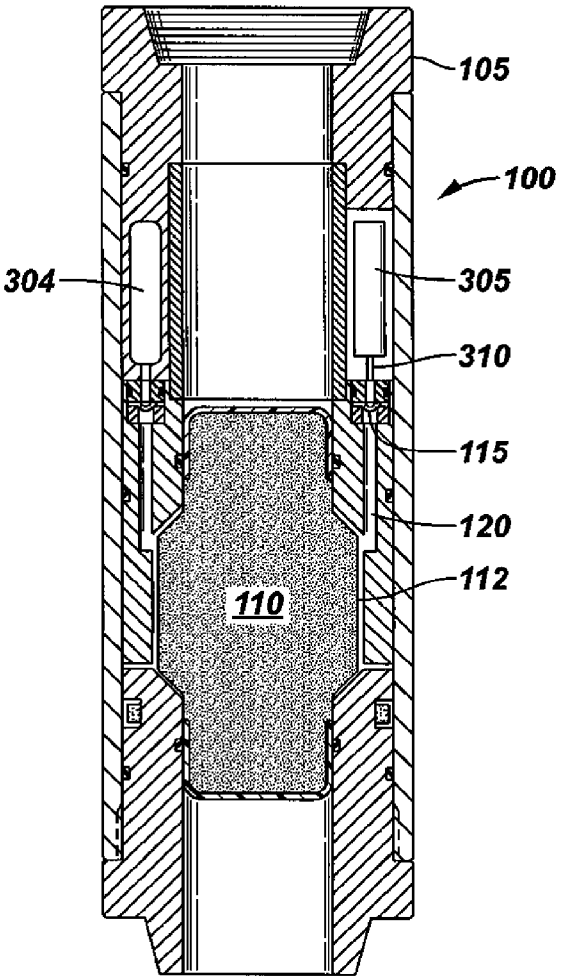
FIG. 3 depicts a cross section view of an illustrative downhole plug assembly with an actuator for introducing fluid to a stopper, according to one or more embodiments described.

FIG. 3 depicts a cross section view of an illustrative downhole plug assembly with an actuator for introducing fluid to a stopper according to one or more embodiments described. In one or more embodiments, the plug assembly 100 can include one or more actuators 305 and/or one or more piercing plungers 310. The actuators 305 and the piercing plungers 310 can be disposed in one or more cavities 304 formed in the wall of the housing 105. The one or more cavities 304 can be in communications with the flow control device 115 such that the piercing plungers 310 can contact the one or more flow control devices 115.

In one or more embodiments, the one or more actuators 305 can be an electro hydraulic having a battery for providing power, electronics for processing a signal, and/or a pressure transducer that can sense pressure signals and actuate based on those pressure signals and/or they can be any known actuator that can be remotely actuated. The one or more actuators 305 can be single shot, multiple cycle, or coded pulse actuators. For example, the one or more actuators 305 can be actuated by a single increase in pressure, after multiple pressure cycles, and/or by a coded pulse.

In one or more embodiments, the piercing plungers 310 can be incorporated into the one or more actuators 305. The one or more piercing plungers 310 can be any shape rod, bar, stick, shaft, dowel, and/or any object that can penetrate the flow control device 115, for example a rupture disc, disposed in the fluid by-pass channel 120. The piercing plungers 310 can be selectively actuated to selectively pierce the flow control device 115 to introduce fluid into the fluid by-pass channel 120 and/or onto the exposed portion 112. The reaction between the introduced fluid and the exposed portion 112 can degrade or disintegrate the stopper 110.

Figure 4:
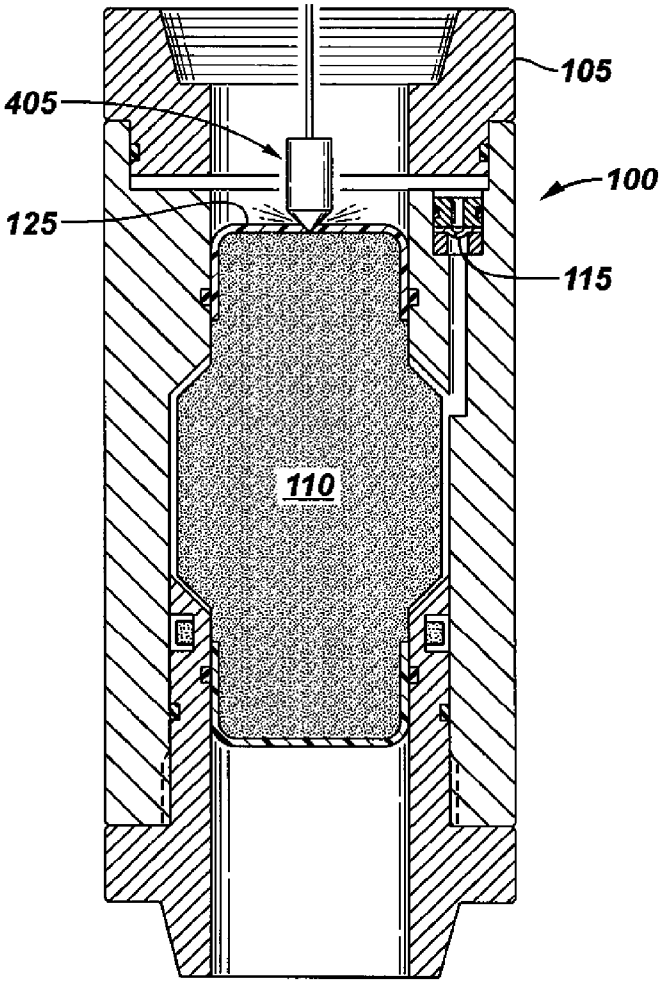
FIG. 4 depicts a cross section view of an illustrative downhole plug assembly including a device to puncture, pierce, break, and/or shatter the cover to allow fluid to come in contact with the stopper, according to one or more embodiments.

FIG. 4 depicts a cross section view of an illustrative downhole plug assembly including a device to puncture, pierce, break, and/or shatter the cover to allow fluid to come in contact with the stopper, according to one or more embodiments. In one or more embodiments, a piercing device 405 can be used in conjunction with the plug assembly 100. For example, in the event that the flow control device 115 malfunctions, the piercing device 405 can be employed as a contingency.

In one or more embodiments, the piercing device 405 can be degradable, dissolvable, and/or disintegradable. The piercing device 405 can be used to pierce the cover 125 to allow wellbore fluid, tubing fluid, and/or combinations thereof to contact the stopper 110. The piercing device 405 can be any shape or size appropriate for piercing the cover 125.

In one or more embodiments, the piercing device 405 can be dropped onto the cover 125 to pierce the cover 125. In a wellbore, not shown, the piercing device 405 can drop down to the lower portion of the wellbore after piercing the cover 125 and after the stopper 110 disintegrates or degrades. In one or more embodiments, the piercing device 405 can dissolve. In one or more embodiments, the reaction between the fluid in the wellbore and the piercing device 405 can degrade, dissolve, and/or disintegrate the piercing device 405 eliminating it as an obstruction to flow through the wellbore.

In one or more embodiments, the piercing device 405 can be transported down the wellbore on wireline, slickline, coiled tubing, pipe, or on any device or using any known method and impacted with the cover 125 with sufficient force to pierce the cover 125. After piercing the cover 125 and/or the flow control device 115 with reference to FIG. 2 above, the piercing device 405 can be retrieved back to the surface.

In one or more embodiments, the reaction between the fluid in the wellbore and the stopper 110 can degrade or disintegrate the stopper 110. The housing 105 can be cleared and full bore, non-restrictive flow can begin. Fluid can flow from below or fluid can be injected from above and through the housing 105. The housing 105 can remain in the wellbore.

In one or more embodiments, the cover 125 can shatter after contact with the piercing device 405 and the shattered material can be carried away from the housing 105 by fluid flow through the housing 105. In one or more embodiments, the cover 125 can at least partially collapse after exposure to fluid flow through the housing 105. The collapsed cover 125 can be carried away from the housing 105 by the fluid flow through the housing 105.

Figure 5:
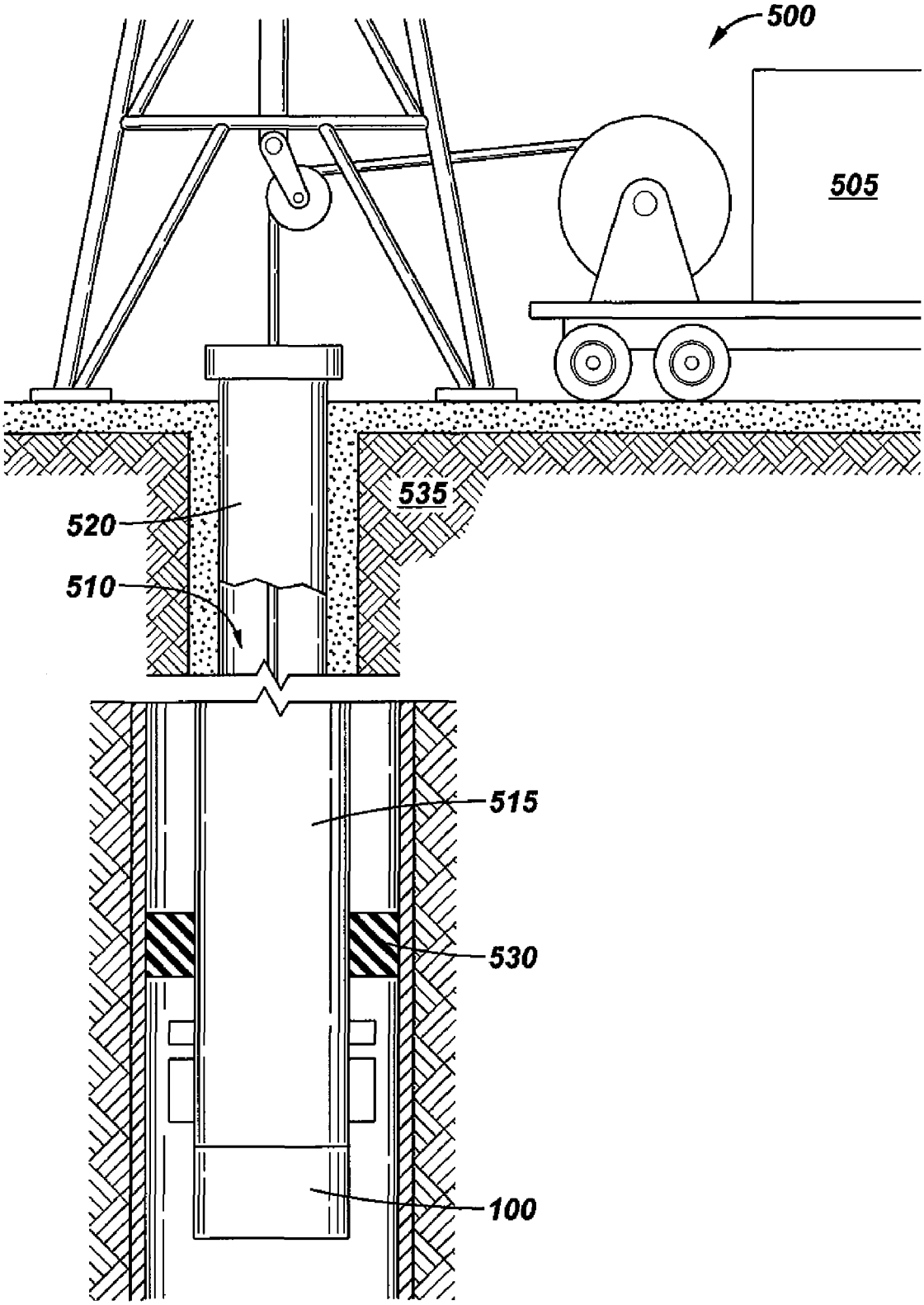
FIG. 5 depicts an elevation view of an illustrative wellbore operation using a plug assembly, according to one or more embodiments described.

FIG. 5 depicts an elevation view of an illustrative wellbore operation using a plug assembly according to one or more embodiments described. In one or more embodiments, the hydrocarbon well operation 500 can include surface support equipment 505, a wellbore 510, production tubing 515, a casing 520, the plug assembly 100, and one or more packers 530. The tubing 515 and the casing 520 can be disposed in the wellbore 510 penetrating earth formations 535. The production tubing 515 and the casing 520 can be used as part of a drilling, testing, completion, production, and/or any other known operation. The packers 530 can be disposed between the production tubing 515 and the casing 520. In one or more embodiments, the packers 530 can be disposed between the production tubing 515 and the wellbore 510 in an open hole arrangement, not shown.

The surface support equipment 505 can be any equipment suitable for providing servicing capabilities to the hydrocarbon well operation 500. For example, the surface support equipment 505 can include computers, pumps, mud reservoirs, towers, and the like. The surface support equipment 505 can support drilling, testing, completion, and/or production of one or more hydrocarbon formations 535 and/or one or more hydrocarbon well operations 500.

In one or more embodiments, the wellbore 510 can be any type of well, including, but not limited to, a producing well, a non-producing well, an injection well, a fluid disposal well, an experimental well, an exploratory well, and the like. The wellbore 510 can be vertical, horizontal, deviated some angle between vertical and horizontal, and combinations thereof, for example a vertical well with a non-vertical component.

The plug assembly 100 can be disposed below the packers 530. In one or more embodiments, the plug assembly 100 can be run on slickline, wireline, coiled tubing, and/or pipe and set below the packers 530. For example, the packers 530 and the plug assembly 100 can be run in the casing 520 on the production tubing 515, to a desired depth. Once disposed at the desired depth, the packers 530 can be expanded to contact the casing 520 or wellbore 510.

In one or more embodiments, the plug assembly 100 can be used to control well pressures in the hydrocarbon formation 535 and/or to set the packers 530. The packers 530 can be set by applying pressure in the production tubing 515 to a pressure greater then the resident annulus pressure. For example, the packers 530 can be a slips and element type packer. An axial load can be applied to the slips and element packer and slips can be pushed up a ramp to compress the element, causing the packers 530 to expand outward to contact the casing 520. The axial loads to expand the packers 530 can be applied hydraulically because the plug assembly 100 can control the pressure from below and from above the packers 530.

In one or more embodiments, any known packer can be used. For example, a non-limiting list of hydraulically set completion and/or production packers can include the packers sold under the trade name XHP PREMIUM PRODUCTION PACKER™ and/or under the trade name MRP MODULAR RETRIEVABLE PACKER™ and available for purchase from SCHLUMBERGER LIMITED (www.slb.com).

In one or more embodiments, one or more packers 530 and the plug assembly 100 can be used during pressure testing, during well logging operations, as suspension barriers for lower completions, or for other uses. In one or more embodiments, the plug assembly 100 can be used as: a pressure barrier during pressure testing, a lower completion suspension barrier, and/or as any downhole barrier. For example, the plug assembly 100 can be used in lieu of a millable casing bridge plug for temporary well suspension. The plug assembly 100 can be used in place of a ball valve or disc valve for isolating the formation 535.

In one or more embodiment, the plug assembly 100 can be used in lieu of a steel retrievable plug. For example, in work over operations to retrieve the upper completion, the plug assembly 100 can be set in the lower completion as a well control barrier and the upper completion can be retrieved. After reinstallation of the upper completion, the plug assembly 100 can be cleared to allow flow up and down the wellbore 510.

In one or more embodiments, the plug assembly 100 can be used as a debris barrier. For example, in a well requiring multi-zone fracture pack sand control, a lower zone can be perforated and then fracture packed. A mechanical fluid loss control, for example a large bore flapper or a ball valve type formation isolation valve, can be closed after completion of the fracture pack operation of the lower zone to isolate the lower zone from upper zone. The plug assembly 100 can be run above the mechanical fluid loss control valve to protect it from the debris generated during perforating the zone above the lower zone. After perforating, the plug assembly 100 can be cleared allowing flow up and down the wellbore 510. In one or more embodiments, the plug assembly 100 can be used for protecting other downhole devices from debris and/or pressure surge.

In one or more embodiments, the plug assembly 100 can include the housing 105 and the stopper 110 disposed in the housing 105, with reference to FIGS. 1 through 4 above. In one or more embodiments, the plug assembly 100 can be used in combination with known production completion equipment and methods using one or more packers, solid tubes, perforated tubes, sliding sleeves and/or other known equipment. The plug assembly 100 can be used for one or more known purposes without requiring intervention. For example, in a hydraulic packer setting operation, the plug assembly 100 can be used to control pressure within the wellbore 510 to set the hydraulic packers 530. After the hydraulic packers 530 are set, the plug assembly 100 can be cleared by degrading the stopper 110 allowing full bore, non-restrictive production through the wellbore 510. In one or more embodiments, a given completion can be run with surface mandrels and safety valves pre-installed.

With reference to FIG. 2 and FIG. 5, at least one non-limiting example of the plug assembly 100 in operation follows: the plug assembly 100 can be disposed in the wellbore 510. A rupture disc can be integrated into the stopper 110 and/or the cover 125 to act as the flow control device 115. The rupture disc can prevent fluid from entering the channel 205. The pressure above the stopper 110 can be increased sufficiently to burst the rupture disc and introduce tubing fluid into the channel 205. The reaction between the tubing fluid, for example brine, and the walls of the channel 205 can degrade or disintegrate the stopper 110. In one or more embodiments, the cover 125 can collapse after the stopper 110 disintegrates. The housing 105 can be cleared and full bore, non-restrictive flow can begin.

As used herein, the terms "up" and "down"; "upper" and "lower"; "upwardly" and "downwardly"; "upstream" and "downstream"; and other like terms are merely used for convenience to depict spatial orientations or spatial relationships relative to one another in a vertical wellbore. However, when applied to equipment and methods for use in wellbores that are deviated or horizontal, it is understood to those of ordinary skill in the art that such terms are intended to refer to a left to right, right to left, or other spatial relationship as appropriate.

Certain embodiments and features have been described using a set of numerical upper limits and a set of numerical lower limits. It should be appreciated that ranges from any lower limit to any upper limit are contemplated unless otherwise indicated. Certain lower limits, upper limits and ranges appear in one or more claims below. All numerical values are "about" or "approximately" the indicated value, and take into account experimental error and variations that would be expected by a person having ordinary skill in the art.

Various terms have been defined above. To the extent a term used in a claim is not defined above, it should be given the broadest definition persons in the pertinent art have given that term as reflected in at least one printed publication or issued patent. Furthermore, all patents, test procedures, and other documents cited in this application are fully incorporated by reference to the extent such disclosure is not inconsistent with this application and for all jurisdictions in which such incorporation is permitted.

While the foregoing is directed to one or more embodiments, other and further embodiments of the invention may be devised without departing from the basic scope thereof, and the scope thereof is determined by the claims that follow.

What is claimed is:

1. A downhole plug, comprising:

a housing having an aperture disposed generally through the center of the housing, a stopper having a composition of at least two different materials, one or more covers at least partially disposed on the stopper, wherein the stopper is at least partially encapsulated by the one or more covers, and wherein the stopper is disposed in the aperture and adapted to block fluid flow therethrough, a fluid bypass channel formed in the housing and in communication with an exposed portion of the stopper at a fluid introduction point on the stopper, a flow control device disposed within the fluid bypass channel and adapted to selectively introduce a fluid to the exposed portion of the stopper, and a cavity formed between an inner wall of the housing and the exposed portion of the stopper, wherein the cavity and the exposed portion extend along at least a portion of an axial length of the stopper from the fluid introduction point.

2. The downhole plug of claim 1, wherein at least one of the two different materials of the stopper is degradable.

3. The downhole plug of claim 1, wherein at least one of the two different materials of the stopper is a reactive metal.

4. The downhole plug of claim 1, wherein at least one of the two different materials of the stopper is a reactive polymer.

5. The downhole plug of claim 1, wherein the stopper has at least one interior void or at least one exterior groove.

6. The downhole plug of claim 5, wherein the stopper has two or more interior voids, and the cross sectional area of each interior void is different.

7. The downhole plug of claim 1, wherein the two different materials of the stopper comprises: (a) a combination of a normally insoluble metal or alloy with one or more elements selected from the group consisting of a second metal or alloy, a semi-metallic material, and non-metallic materials; or (b) one or more solubility-modified high strength and/or high-toughness polymeric materials selected from the group consisting of aromatic polyamides, polyethers, and liquid crystal polymers.

8. The downhole plug of claim 1, further comprising one or more channels formed in the interior of at least a portion of the stopper.

9. The downhole plug of claim 1, wherein the fluid bypass channel allows the fluid to be directed around at least one of the covers.

10. The downhole plug of claim 9, wherein the flow control device comprises a degradable composition disposed inside the fluid bypass channel.

11. The downhole plug of claim 1, further comprising a fluid absorbing coating disposed on at least a portion of the exposed portion of the stopper, wherein the fluid absorbing coating can at least partially control the flow rate of fluid contact between the stopper and any fluid present about the exposed portion of the stopper.

12. The downhole plug of claim 1, further comprising a desiccant material in fluid communication with the cavity.

13. The downhole plug of claim 1, wherein an inert gas is disposed in the cavity.

14. The downhole plug of claim 1, further comprising a seal disposed between the one or more covers and the inner wall of the housing.

15. A downhole plug, comprising:

a housing having an aperture disposed generally through the center of the housing, a stopper having a composition of at least two different materials, one or more covers at least partially disposed on the stopper, wherein the stopper is at least partially encapsulated by the one or more covers, and wherein the stopper is disposed in the aperture and adapted to block fluid flow therethrough, a fluid bypass channel formed in the housing and in communication with an exposed portion of the stopper at a fluid introduction point on the stopper, a flow control device disposed within the fluid bypass channel and adapted to selectively introduce a fluid to at least a portion of the exposed portion of the stopper, wherein the flow control device comprises at least one of a rupture disc, a pressure-actuated valve, a pressure transducer, and a degradable composition, and a cavity formed between an inner wall of the housing and the exposed portion of the stopper, wherein the cavity and the exposed portion extend along at least a portion of an axial length of the stopper from the fluid introduction point.

16. The downhole plug of claim 15, further comprising a seal disposed between the one or more covers and the inner wall of the housing.

17. A method for operating a wellbore using a downhole plug, comprising:

positioning a downhole plug within a wellbore, wherein the downhole plug comprises:

a housing having an aperture disposed generally through the center of the housing, a stopper having a composition of at least two different materials, one or more covers at least partially disposed on the stopper, wherein the stopper is at least partially encapsulated by the one or more covers, and wherein the stopper is disposed in the aperture and adapted to block fluid flow therethrough, a fluid bypass channel formed in the housing and adapted and in communication with an exposed portion of the stopper at a fluid introduction point on the stopper, a flow control device disposed within the fluid bypass channel and adapted to selectively introduce a fluid to the exposed portion of the stopper, and a cavity formed between an inner wall of the housing and the exposed portion of the stopper, wherein the cavity and the exposed portion extend along at least a portion of an axial length of the stopper from the fluid introduction point;

performing wellbore operations supported by the downhole plug; and clearing the aperture by actuating the flow control device to introduce the fluid onto the stopper to clear the blockage and allow fluid flow through the housing.

18. The method for wellbore operations of claim 17, further comprising actuating the flow control device by increasing the pressure in the wellbore.

19. The method for wellbore operations of claim 17, further comprising actuating the flow control device after multiple pressure cycles.

20. The method for wellbore operations of claim 17, further comprising actuating the flow control device by communicating coded signals into the wellbore.

21. The method for wellbore operations of claim 17, further comprising dropping a piercing device down a wellbore, and piercing a portion of the cover to introduce fluid to the stopper.

22. The method for wellbore operations of claim 17, further comprising transporting a piercing device down a wellbore, and piercing a portion of the cover to introduce fluid to the stopper.

23. The downhole plug of claim 17, further comprising a seal disposed between the one or more covers and the inner wall of the housing.

* * * * *